United States Patent [19]

Franklin

[11] Patent Number: 4,543,668

[45] Date of Patent: Oct. 1, 1985

[54] DISPOSABLE TORSO COVERS

[76] Inventor: Marilyn L. Franklin, 10311 Colorado Cir., Bloomington, Minn. 55438

[21] Appl. No.: 585,841

[22] Filed: Mar. 2, 1984

Related U.S. Application Data

[63] Continuation-in-part of Ser. No. 507,282, Jun. 23, 1983, abandoned.

[51] Int. Cl.[4] ..... A41B 13/10

[52] U.S. Cl. ..... 2/48; 2/49 R; 2/49 A

[58] Field of Search ..... 2/49 R, 49 A, 48, 74, 2/75, DIG. 7, 114, 84; 206/390, 226, 574, 820, 39.7, 39.8

[56] References Cited

U.S. PATENT DOCUMENTS

| | | | |
|---|---|---|---|
| 142,073 | 8/1873 | Bates | 206/391 |
| 462,004 | 10/1891 | Hahn | 206/227 |
| 1,211,832 | 1/1917 | Elliott | 2/74 |
| 2,224,746 | 12/1940 | Richstein | 2/49 |
| 2,717,390 | 9/1955 | Houze | 2/74 |
| 2,756,430 | 7/1956 | West . | |
| 3,131,399 | 5/1964 | Murphy et al. . | |
| 3,496,815 | 2/1970 | Ruhl . | |
| 3,793,644 | 2/1974 | Kellner | 2/49 R |
| 3,851,760 | 12/1974 | Smith | 2/49 R |
| 3,945,048 | 3/1976 | Shearer | 2/49 R |
| 4,186,443 | 2/1980 | Britzman . | |
| 4,215,432 | 8/1980 | Smith . | |
| 4,225,977 | 10/1980 | Smith . | |
| 4,313,229 | 2/1982 | Villafane | 2/84 |
| 4,330,888 | 5/1982 | Klepfer . | |
| 4,416,025 | 11/1983 | Moret et al. | 2/49 R |
| 4,442,552 | 4/1984 | Bolick | 2/49 R |
| 4,445,231 | 5/1984 | Noel | 2/49 R |

*Primary Examiner*—Werner H. Schroeder
*Assistant Examiner*—Mary A. Ellis
*Attorney, Agent, or Firm*—Robert C. Baker

[57] ABSTRACT

Disposable torso-cover sheet stock consisting essentially of a roll of flexible sheet material having defined therein, by transverse lines at which said sheet material is readily severable, a plurality of disposable torso covers of rectangular shape, each having an interior severance line in the shape of a T, with no part thereof of the T extending to any edge of said rectangular shape, the T being openable for a head to pass therethrough, the crossbar portion of the T being parallel with one of the narrower sides of said rectangular shape and its depending stem portion being approximately equally spaced from and parallel to each of the longer sides of said rectangular shape. Preferably, belt loop lines of severance are provided in the sheet stock and a roll of belting is included.

23 Claims, 6 Drawing Figures

FIG. 1
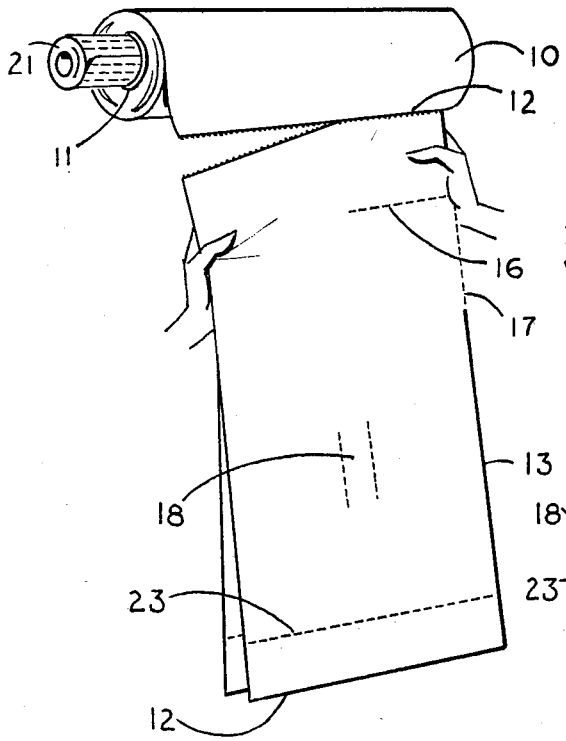
FIG. 2
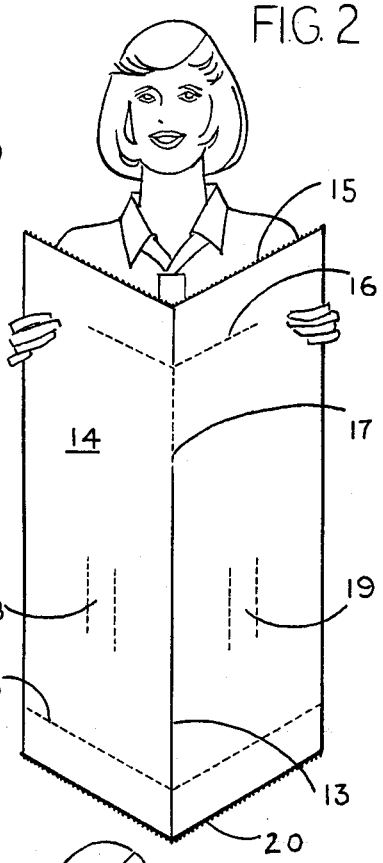
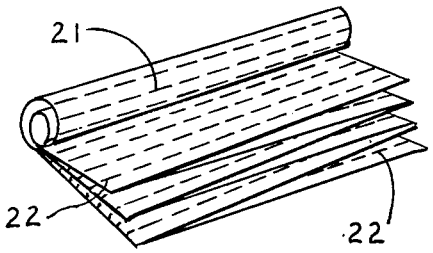
FIG. 3
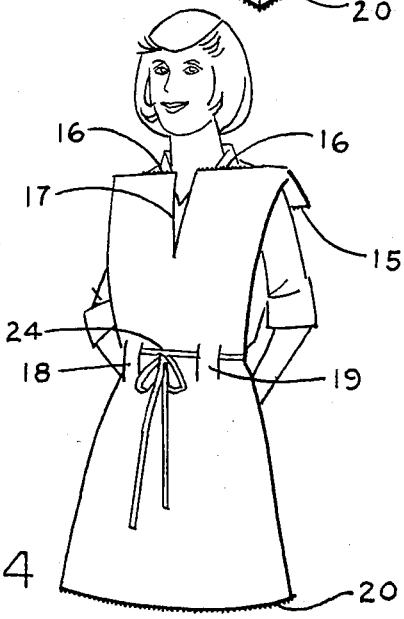
FIG. 4

DISPOSABLE TORSO COVERS

CROSS REFERENCE TO RELATED APPLICATION

This application is a continuation-in-part of my application Ser. No. 06/507,282, filed June 23, 1983, now abandoned.

BACKGROUND OF THE INVENTION

This invention relates to disposable torso covers such as aprons, bibs, modesty covers, and smocks. More particularly, the invention relates to disposable sheet stock in the form of a roll of flexible sheet material having a plurality of disposable torso covers defined therein by transverse lines at which the sheet material is readily severable.

Much effort has heretofore been directed toward solving the problem of providing easily and economically manufactured and functionally satisfactory disposable torso covers, particularly aprons. Rolls of disposable aprons have heretofore been suggested; the use of transverse lines for severance of disposable aprons from a roll thereof has been suggested; folded sheet stock in roll form has been suggested; and even the expedient of adhesive attachment to a user has been offered as a solution.

However, all known expedients for disposable torso covers have suffered from design or structural or functional problems which add to cost of manufacture or introduce problems for a user. For example, some known disposable torso covers in the form of aprons have portions which are cut out and removed entirely, which causes expense and waste of material. Some have so many severance lines that they are difficult to sever from a roll as discrete apron sheets. Some provide only limited apron coverage, or require special components which must be attached properly by a user and thus are relatively cumbersome or bothersome to use.

Nevertheless, the need for disposable torso cover sheet stock, easily and economically manufactured, with waste of material avoided both at the manufacturing level and the user level, and with the stock quickly and easily severable at the user level to provide discrete disposable aprons or other torso covers of a highly attractive and functional nature, has never been satisfied insofar as is known until this invention. That need has grown over time as various establishments desirous of an enhanced or favorable image (whether before the public or with employees) have incurred greater and greater expense for laundering and upkeep of non-disposable apron type uniforms. That expense would fondly be avoided were there available visually attractive as well as functionally effective aprons or cover-ups of a character so economical to adopt as to justify quick disposal of those soiled in favor of neat fresh ones. This invention provides such a solution.

Illustratively, torso covers of the invention are useful in schools by students in the crafts and trades and artistic areas as well as by teachers. They are useful in restaurants and fast food chains, both by those served and those serving. They are useful in nursing homes, day care centers, laboratories, grocery stores, factories, and cosmetic estalishments. They are useful for cooks, cleaners, painters, campers, and a countless number of uses around the house. And torso covers of the invention in the form of modesty covers are especially useful as examination gowns or covers in doctors' offices and hospitals.

SUMMARY OF THE INVENTION

The invention provides a disposable rectangular-shaped torso cover having an interior severance line in the shape of a T. The T-shaped interior severance line has no part thereof extending to any edge of the rectangular shape, and is openable as a T-shaped opening for a head to pass therethrough. Further, the T-shaped interior severance line has its crossbar portion extending in a direction parallel with one of the narrower sides of the rectangular shape and has its depending stem portion approximately equally spaced from and parallel to each of the longer sides of the rectangular shape. The portion of the rectangular shape located adjacent the crossbar portion of the T on the side of the crossbar portion opposite the depending stem portion is functionable as a yoke. The portion of the rectangular shape at each end of the crossbar portion of the T is functionable as an over-shoulder covering. The portion of the rectangular shape on each side of the stem of the T is functionable as a front upper torso covering. And the portion of the rectangular shape below the stem of the T is functionable as a front torso covering.

More especially, the invention provides new articles of manufacture, namely disposable torso-cover sheet stock consisting essentially of a roll of flexible sheet material having defined therein, by transverse lines at which the sheet material is readily severable, a plurality of disposable torso covers of rectangular shape, with each rectangular torso cover having an interior severance line in the shape of a T.

The arrangement of features of the torso covers provides an extraordinarily attractive appearance for the torso cover on a user; yet the torso cover is literally no more than a flat sheet.

Preferably, the flexible sheet material of the roll of disposable torso-cover stock is folded with the fold extending lengthwise in the roll.

The ideal sheet material for the torso cover is simply paper, preferably paper of a paper towel character, although other sheet materials such as those of organic plastics film character may be employed, if desired.

While belting may be applied about the body of a user to hold the torso cover in place without threading the belting through belt loops, a preferred torso cover stock of the invention includes a couple pairs of parallel severance lines openable to form belt loops.

A further preferred feature is that of providing flexible belting material in the form of a sheet material having a plurality of belts defined therein by longitudinal lines of severance; and the belting material most preferably consists of a flexible sheet or film of organic plastics material.

Belting material out of which belts may be severed is preferably but optionally accordion folded and then wound into roll form and slipped inside a core about which the disposable torso cover sheet stock is rolled.

DESCRIPTION OF DRAWINGS

FIG. 1 is a schematic perspective view of a composite article of manufacture according to the invention, including both the disposable apron or torso-cover stock in roll form and the belting stock in roll form within the core of the roll of apron stock (with the belting roll shown partially removed for illustration purposes);

FIG. 2 is a schematic view of a rectangular apron of the invention after severance from the roll stock, with the apron shown in partially unfolded condition as compared to its preferred folded condition in roll stock;

FIG. 3 is a schematic perspective view of belt stock shown in a condition of partial unrolling and illustrating the accordion folding of it;

FIG. 4 is a schematic perspective view of the apron as employed by a user;

DESCRIPTION OF PREFERRED EMBODIMENTS

Figure 5:
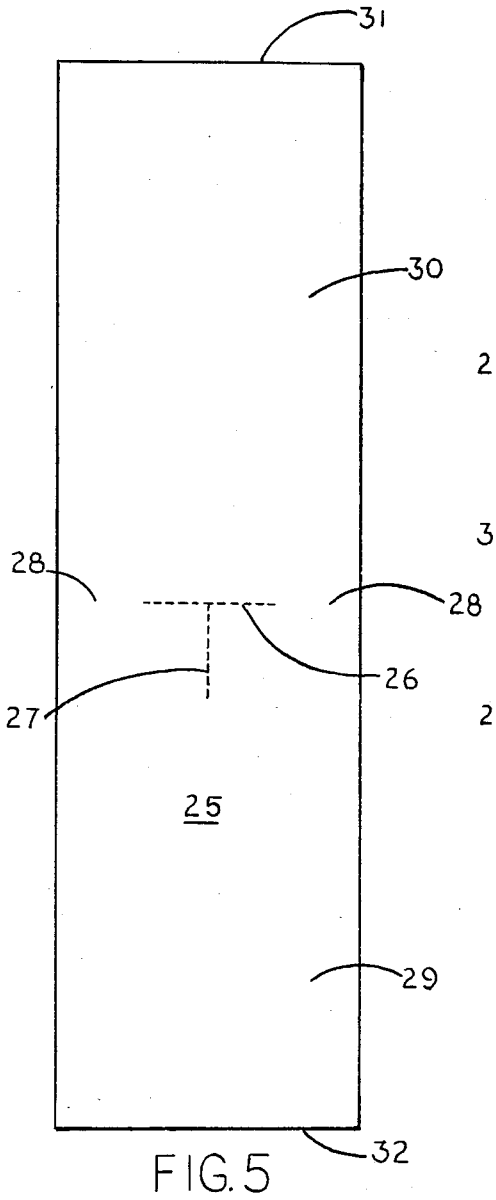
FIG. 5 is a plan view of a rectangular sheet having a T-shaped severance line about midway in the sheet and illustrating the shape of a rectangular sheet useful for forming a modesty or smock-like torso cover of the invention.

Referring to FIG. 1, the disposable apron stock consists essentially of a roll 10 of flexible sheet material. It is shown wound about a hollow cylindrical core 11. Transverse lines 12 at which the sheet material is readily severable serve to define the limits of discrete aprons in the roll of sheet material. (To be recognized is that the option does exist for some sections of the roll of apron stock to be devoted to other use such as belting, in which event zig-zag lines of scoring may be employed so as to inherently cause additional length as may be needed should any optional belting stretches be incorporated in the roll of apron sheet stock itself.) Whether with or without optional intermediate sections devoted to articles other than aprons, the aprons of the invention in the roll of apron sheet stock are defined by transverse lines 12 at which the sheet material or sheet stock is readily severable; and to be noted is that these transverse lines 12 extend completely across the sheet material in the roll.

Typically, the transverse lines are scored lines, that is lines of weakness or cut, or an equivalent severance or scoring line such as commonly formed by a multiplicity of slits, apertures, or perforations. The preferred feature is that the transverse severance lines are lines of weakness, and even very substantial weakness, so that individual aprons can be quickly and easily and readily severed by hand action from the sheet stock.

Further referring to FIG. 1, it will be noted that the illustrated simplicity of construction is that of a folded condition for the apron sheet stock in the roll. This is best described by considering FIGS. 1 and 2 together. In FIG. 2, the line of fold 13 of one rectangular apron 14 severed from the roll 10 is illustrated by the fact that the fold of the apron is shown in a partially unfolded condition from its folded condition as it preferably exists in the roll of apron sheet stock.

For convenience, the rectangular apron may be considered as having an upper half and a lower half. Within the upper half (considered as an approximation as distinct from an exact measurement) is located a severance line of T shape and which is openable for a head to pass through. This T severance line, formed by scoring or equivalent, is below but proximate to the upper or top narrower side of the rectangular shape of the apron. The top narrower side (sometimes called the one narrower side) is given reference character 15 in FIG. 2. The crossbar portion 16 of the T is substantially parallel to that one narrower or upper side 15; and the depending stem 17 of the T is approximately equally spaced and parallel to each of the longer sides of the rectangular shape. To be particularly noted is that the folded condition of the apron in the sheet material stock (FIG. 1) is such that the stem 17 of the T preferably is at the edge of the sheet stock and the crossbar 16 portion extends from one side of the folded sheet stock into the center portion of each layer of the folded sheet stock. While the length of the crossbar portion 16 of the T may indeed be so long as to extend a little more than half way across the folded condition of the apron, it will never extend completely across the width of the apron. That is, it will never extend completely across the folded condition of the apron stock. Stated another way, the crossbar portion of the T should terminate so that at each end of it, there should remain a space or distance equal to at least approximately one-eighth the total width of the apron, and preferably up to approximately one-fourth the total width of the apron. The depending stem of the T should depend from the crossbar a distance no more than, or no greater than, approximately midway the total length of the rectangular apron; that is, the depending stem should not depend more than approximately to the mid-point of the total rectangular shape of the apron. Illustratively, the crossbar may be twice the length of the stem of the T, with the stem depending from the center of the crossbar.

A preferred feature is that of incorporating in the sheet stock certain special severance lines in pairs for the purpose of permitting the formation, quickly by severance, of narrow belt loop strips in the rectangular apron sheet. Two pairs of severance lines are shown; one pair for forming belt loop 18 and the other forming belt loop 19. The severance lines for the belt loops should be located in the lower half of the rectangular apron; or stated another way, the pairs of severance lines for forming belt loops 18 and 19 should be in the half of the rectangular apron other than the half containing the T-scored line. They should be positioned in the rectangular stock for approximately a waist level as the rectangular stock is employed as an apron. The parallel paired severance lines for each pair should be oriented in a manner substantially parallel with the longer edges of the rectangular apron; stated another way, they should be aligned with the length or longest direction of the rectangular apron. The length of these severance lines may be extremely modest and just adequate to accommodate threading of a narrow belt through the loop formed thereby. The pairs of belt loop severance lines are laterally spaced in the transverse direction, and preferably located in the longitudinal direction approximately midway between the distance of the lower apron portion defined as that between the termination of the stem of the T line and the opposite edge or lower edge 20 of the rectangular apron.

To be particularly noted is that the folded condition of the apron stock in roll form presents an attractive approach for manufacturing and one literally permitting a folded blank stock to be line scored (or equivalent) for severance at all lines of severance in a substantially automatic and quick manner, which affords extraordinary economy for manufacture. Illustratively, the line 12 of severance between aprons may be formed by scoring such as interrupted cutting or perforation; the crossbar line 16 of the T shape likewise so formed; the pair of lines for each pair of belt loops likewise; and the stem portion 17 of the T likewise. Of course, lines of severance which are essentially lengthwise in the roll, such as the severance line of the stem 17 and those for forming belt loops 18 and 19, may in fact be completely cut through in manufacture since they are so oriented that roll integrity and removal of discrete rectangular aprons is not impaired or made clumsy (by gaps or premature severance when pulling an apron from the roll) when complete cut is employed at those lines of severance. Thus a complete cut at those lines constitutes an equivalent scoring for them. All severance lines, other than the stem 17 of the T, are in mirror relationship in the folded sheet stock (and even the stem of the T may be looked upon as having that relationship, since it may be formed in folded stock by cutout of a fractional strip). As such the lines on one layer of the folded material are in register with those of the other layer of the folded stock; and quick automatic scoring in manufacture is feasible.

Referring to FIGS. 1 and 3, belting material 21 in roll form for use in practicing the invention is most preferably supplied as a sheet having lines 22 of scoring or the like for ready severance of individual belts. Since belts are generally longer than conveniently incorporated in apron roll stock, whether at a lateral location in a roll or at a location intermediate individual discrete aprons in a roll, I prefer to incorporate belt material as part of the composite package for marketing in a sheet material having the desired strength and length for belting; and most preferably films of organic plastics materials (e.g., polyethylene, polyvinylchloride, etc.) are employed for this purpose. A length of belting sheet material, for example, approximately 152 centimeters (60 inches) or 168 centimeters (66 inches) long, is provided with score lines 22 lengthwise thereof. Severance at the score lines provides belts; and each belt may be on the order of one centimeter (one-fourth inch) in width, or wider if desired, even as wide as five centimeters (a couple inches.) But economy usually is desired; and very narrow belts—even as narrow as a half centimeter (or about one-eighth inch) or so in width—are most preferred. The problem of handling such long belt sheet material stock is solved by the approach illustrated in FIG. 3, which provides great convenience to the user and is not an expensive step for manufacture. As there illustrated, the length of belting sheet stock, after being provided with score lines, is accordion folded with the folds transverse to the length thereof. The folds are thus transverse to the score lines for severing individual belts. Then the manufacturer rolls the resulting accordion folded material so as to form a roll with the score lines of severance parallel with the axis of the roll. The resulting roll is easily inserted within the core 11 (suitably a core of cardboard or plastic) about which the apron sheet stock is wound in roll form. The user simply removes the roll of belting sheet material and then tears off an individual belt from the end of that belting roll without having to totally unroll that belting sheet stock. The belting stock thus is readily replaced within the core of the roll of apron stock after an individual belt is removed for use. Alternatively, should the roll of apron sheet stock be mounted on a dispenser with elements projecting into the core 11 to hold it for unrolling, the roll of belting material may be placed at a nearby location and made readily available as needed.

If desired, a transverse line of severance 23 spaced from and parallel with the lower edge of rectangular aprons of the invention may be included for the purpose of allowing a convenient way for a user to shorten the length of an apron.

Despite the basic unattractiveness of the rectangular aprons as they exist immediately after severance from the sheet stock, astonishing attractiveness results when the apron rectangle is placed on a user, as illustrated in FIG. 4. The severance line of T shape becomes the neck opening, with the stem 17 of the T providing an attractive slit from the neck. The apron sheet material between the crossbar of the T and the top narrower edge 15 forms a yoke about the back of the neck of a user and across substantially the entire back of the user. The apron sheet material at each end of the crossbar of the T functions as an over shoulder covering. Interestingly, the spread of the T, particularly the crossbar of the T, to accommodate the neck also functions to "lower" the over shoulder covering portion, which is functionally advantageous and maintains coverage close to the neck. Importantly, the apron sheet material on each side of the stem 17 of the T covers the upper torso at the front of the user. Belt 24 from the belting sheet stock holds the apron on the front of the user in a manner pleasing to the eye. However, belt fastening may be omitted, if desired.

The specific size of aprons formed in accordance with my invention may vary. Specifics for one illustrative size will now be offered for illustration purposes. Suitably, the transverse score lines 12 separating aprons in a roll may be spaced approximately 122 centimeters (48 inches) apart, to form aprons having a rectangular length of approximately 122 cm. (48 in.). The width of the rectangular aprons may be on the order of about 58 cm. (22 ½ in.). The crossbar of the T may be spaced from the upper edge a distance of about 12 cm. (5 in.) with the length of the scoring for the crossbar being approximately 29 cm. (11 ¾ in.) and spaced at its ends about 14.5 cm. (5 ⅜ in.) from each side edge of the apron. The stem of the T may extend downwardly from the crossbar about 14.5 cm. (5 ½ in.) and be equally spaced from each side edge. Belt score lines or openings may extend from about 45.5 cm. up to 53 cm. (18 up to 21 in.) from the upper edge or top of the rectangular apron, with each score line of the pair about 5 cm. (2 in.) apart and the outer line of each pair spaced inwardly from the edge of the apron approximately 10 to 12 cm. (4 or 5 in.). Optionally, if desired, a score line spaced approximately 20 cm. (8 in.) from the bottom of the rectangular apron may be provided should one desire to incorporate in a single roll the possibility for aprons of varied length.

Figure 6:
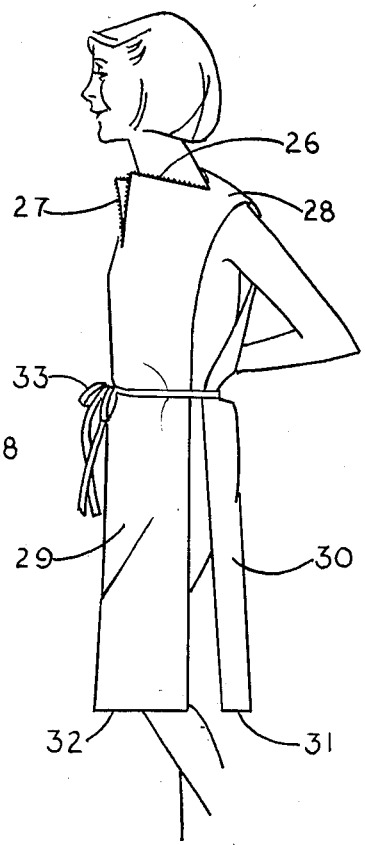
FIG. 6 is a schematic side perspective view of a torso cover as illustrated in sheet form in FIG. 5, showing that torso cover as worn by an individual with a belt at the waist and with the torso cover extending down the back to the knees as well as down the front to the knees of the individual.

Referring now to FIGS. 5 and 6, an explanation will be given as to the significant features there illustrated for a torso cover in the nature of a modesty covering useful by individuals who are undergoing examination in a doctor's office or in hospitals and are expected to present themselves quickly in the nude for such examination. The same torso cover as illustrated in FIGS. 5 and 6 is also useful as a smock covering over a clothed individual.

The basic character of this torso cover 25 is that of a rectangular sheet having about midway therein a T-shaped severance line formed of the crossbar portion 26 of the T and the stem 27 of the T. Again, the crossbar portion is as aforedescribed, namely a severance line which does not extend to the very edge of the rectangular shape of material. The space between the ends of the crossbar portion 26 and the edge of the material, given numeral 28, serves as the over-shoulder portion as the torso cover is worn by an individual. To be especially recognized is that the crossbar portion 26 of the T is approximately midway between the ends 31 and 32 of the rectangular shape. The front portion 29 of the covering is the portion having the stem 27 of the T severance line extending thereinto from the crossbar severance line 26 of the T. The rear or back panel 30 of the torso cover is that portion on the side of the crossbar 26 of the T lacking the stem 27.

While parallel slits for forming belt loops may be incorporated as part of the rectangular sheet illustrated in FIG. 5, using principles as aforediscussed, it is frequently unnecessary to employ such special slits to form belt loops. Instead, the rectangular shape as illustrated in FIG. 5 may be fitted over an individual as illustrated in FIG. 6 and a belt 33 such as aforedescribed may be wrapped around the individual's waist and tied. Optionally, an individual undergoing examination in a hospital may simply place his or her hands at his or her hips to hold the edges of the front 29 and back 30 portions of the torso cover toward a meeting relationship at his or her hips. Observe as aforediscussed the special nature of the T-shaped severance line which forms the neck opening for the wearer. The portion of the rectangular shape located adjacent the crossbar portion 26 of the T and located on the side of the crossbar portion opposite the depending stem portion is functionable as a yoke across the back of the wearer.

It is emphasized that the torso cover of FIG. 5 is conveniently incorporated into roll form as discussed in connection with the illustration of FIG. 1, preferably with the rectangular length of material folded and the stem 27 of the T lying on the fold line of the material—a feature also discussed with respect to FIG. 1. In roll form, the torso cover of FIG. 5 would have transverse severance lines such as aforediscussed at the ends 31 and 32.

It should be appreciated that bib-like garments are but aprons of the character described and claimed herein. The torso covers may be of varied length. Generally, the sheet material of the torso covers will be opaque, but where not used for modesty purposes, the sheet material may be transparent.

It will be evident to those skilled in the art that the illustrative teachings set forth herein may be varied from the specifically illustrated features and embodiments without departing from the essential teachings of the invention; equivalents, whether known or hereafter developed, may be employed. Also, various designs of artistic nature may be printed or embossed on the torso-cover or belt stock. Thus, the claims appended hereto are intended to be construed with full breadth consistent with their validity.

That which is claimed is:

1. As a new article of manufacture: a disposable torso cover consisting of a rectangular shape of sheet material, said rectangular shape consisting solely of a single layer thickness of said sheet material throughout the entire expanse of said rectangular shape and having within the rectangular shape an interior severance line in the shape of a T, said T-shaped interior severance line having no part thereof extending to any edge of said rectangular shape and being openable as a T-shaped opening for a head to pass therethrough, said T-shaped interior severance line having its crossbar portion spaced from and extending in a direction parallel with one of the narrower sides of said rectangular shape and having its depending stem portion approximately equally spaced from and parallel to each of the longer side edges of said rectangular shape, said longer side edges having nor part thereof connected to any other part thereof, said portion of said rectangular shape at each end of the crossbar portion of the T being functionable as an over-shoulder covering, said portion of said rectangular shape on each side of the stem of the T being functionable as a front upper torso covering, said portion of said rectangular shape below the stem of the T being functionable as a front torso covering, and said portion of said rectangular shape between the crossbar of the T and said one narrower side being functionalbe as a depending yoke backing across the back of a user with its sole connection to the remaining expanse of said rectangular shape located at said over-shoulder portion.

2. The article of claim 1 wherein said crossbar portion of the T is located approximately midway between the narrower side edges of the rectangular shape, the torso cover being adapted to cover both the front and back of an individual.

3. As a new article of manufacture: disposable torso-cover sheet stock consisting of a roll of a longitudinal length of flexibel sheet material having defined therein, by transverse lines at which said sheet material is readily severable, a plurality of disposable torso covers each consisting of a rectangular shape of said sheet material, each said rectangular shape having its longest dimension in the longitudinal direction of the length of the flexible sheet material of said roll and having its upper edge and its lower edge at a said transverse line of severance, each said rectangular shape having an interior severance line in the shape of a T, said T-shaped interior severance line having no part thereof extending to any edge of said rectangular shape, said T-shaped interior severance line having its crossbar portion extending in a direction parallel with the upper and lower edges of said rectangular shape and spaced approximately midway between said upper and lower edges, said depending stem portion of said T-shaped severance line being approximately equally spaced from and parallel to each of the longer side edges of said rectangular shape, said longer side edges having no part thereof connected to any other part thereof, each said rectangular shape consisting solely of a single layer thickness of said sheet material throughout the entire expanse of said rectangular shape, said T-shaped severance line being openable for a head to pass therethrough, said portion of said rectangular shape at each end of the crossbar portion of the T being functionable as an over-shoulder covering, said portion of said rectangular shape on each side of the stem of the T being functionable as a front upper torso covering, said portion of said rectangular shape below the stem of the T being functionable as a front torso covering, and said portion of said rectangular shape on the side of the crossbar portion opposite the depending stem portion being functionable as a back covering depending downwardly from said over-shoulder portion with the sole connection of said back covering to the remaining expanse of said rectangular shape being at said over-shoulder portion.

4. The article of claim 3 wherein said flexible sheet material of said roll is folded with the fold lengthwise in the roll, and with the severance line of the stem of the T of said rectangular-shaped torso covers extending substantially along the folded edge and the other severance lines of said folded sheet material in mirror image relationship in said roll.

5. The article of claim 3 wherein said flexible sheet material comprises paper.

6. The article of claim 3 wherein said rectangular-shaped torso covers include two pairs of parallel severance lines openable to form two belt loops, each said pair of severance lines being parallel to the longer side edges of the rectangular shapes and being located in the portion of the rectangular shapes below the stem of the T severance line thereof.

7. The article of claim 3 additionally including a flexible belting roll comprising a belting sheet material having defined therein, by longitudinal lines at which said belting sheet material is readily severable, a plurality of disposable belts, said belting sheet material being accordion folded transversely to said severance lines thereof with the accordion folded severance lines thereof lying in the axial direction in said belting roll.

8. The article of claim 3 having a hollow core member about which said roll of sheet stock is wound and additionally including a roll of flexible belting material removably lodged within said hollow core member.

9. The article of claim 8 wherein said flexible belting material comprises a film of flexible organic plastics material.

10. As a new article of manufacture: disposable apron sheet stock consisting of a roll of flexible sheet material having defined therein, by transverse lines at which said sheet material is readily severable, a plurality of disposable aprons each consisting of a rectangular shape of said sheet material, each said rectangular shape having an interior severance line in the shape of a T openable for a head to pass through, with the crossbar portion of the T spaced below but proximate to and parallel with one of the narrower sides of said rectangular shape, and with the depending stem of the T approximately equally spaced from and parallel to each of the longer side edges of said rectangular shape and depending no more than midway the total length of said rectangular shape, said longer side edges having no part thereof connected to any other part thereof, each said rectangular shape consisting solely of a single layer thickness of said sheet material throughout the entire expanse of said rectangular shape, the expanse of apron rectangular shape below the stem of the T being characterized as the lower apron portion, said portion of said apron rectangular shape at each end of the crossbar portion of the T being functionable as an over shoulder covering, said portion of said apron rectangular shape on each side of the stem of the T being functionable as an upper torso covering, and said portion of said apron rectangular shape between the crossbar of the T and said one narrower side being functionable as a depending yoke backing across the back of a user with its sole connection to the remaining expanse of said apron rectangular shape located at said over-shoulder portion.

11. The article of claim 10 wherein said flexible sheet material of said roll is folded with the fold lengthwise in the roll, and with the severance line of the stem of the T of said rectangular aprons extending substantially along the folded edge and the other severance lines of said folded sheet material in mirror image relationship in said roll.

12. The article of claim 10 wherein said flexible sheet material comprises paper.

13. The article of claim 10 wherein said apron rectangular shape includes two pairs of parallel severance lines openable to form two belt loops, each said pair of severance lines being in said lower apron portion with said lines of severance thereof parallel to the longer side edges of said rectangular shape.

14. The article of claim 10 additionally including a flexible belting roll comprising a belting sheet material having defined therein, by longitudinal lines at which said belting sheet material is readily severable, a plurality of disposable belts, said belting sheet material being accordion folded transversely to said severance lines thereof with the accordion folded severance lines thereof lying in the axial direction in said belting roll.

15. The article of claim 10 having a hollow core member about which said roll of apron stock is wound and additionally including a roll of flexible belting material removably lodged within said hollow core member.

16. The article of claim 15 wherein said flexible belting material comprises a film of flexible organic plastics material.

17. As a new article of manufacture: disposable torso-cover sheet stock consisting essentially of a roll of flexible sheet material having defined therein, by transverse lines at which said sheet material is readily severable, a plurality of disposable torso covers of rectangular shape, each said rectangular torso cover having an interior severance line in the shape of a T, said T-shaped interior severance line having no part thereof extending to any edge of said rectangular shape and being openable as a T-shaped opening for a head to pass therethrough, said T-shaped interior severance line having its crossbar portion extending in a direction parallel with one of the narrower sides of said rectangular shape and having its depending stem portion approximately equally spaced from and parallel to each of the longer sides of said rectangular shape, said portion of said rectangular shape located adjacent the crossbar portion of the T on the side of said crossbar portion opposite the depending stem portion being functionable as a yoke, said portion of said rectangular shape at each end of the crossbar portion of the T being functionable as an over-shoulder covering, said portion of said rectangular shape on each side of the stem of the T being functionable as a front upper torso covering, and said portion of said rectangular shape below the stem of the T being functionable as a front torso covering, said article additionally including a flexible belting roll comprising a belting sheet material having defined therein, by longitudinal lines at which said belting sheet material is readily severable, a plurality of disposable belts, said belting sheet material being accordion folded transversely to said severance lines thereof with the accordion folded severance lines thereof lying in the axial direction in said belting roll.

18. As a new article of manufacture: disposable torso-cover sheet stock consisting essentially of a roll of flexible sheet material having defined therein, by transverse lines at which said sheet material is readily severable, a plurality of disposable torso covers of rectangular shape, each said rectangular torso cover having an interior severance line in the shape of a T, said T-shaped interior severance line having no part thereof extending to any edge of said rectangular shape and being openable as a T-shaped opening for a head to pass therethrough, said T-shaped interior severance line having its crossbar portion extending in a direction parallel with one of the narrower sides of said rectangular shape and having its depending stem portion approximately equally spaced from and parallel to each of the longer sides of said rectangular shape, said portion of said rectangular shape located adjacent the crossbar portion of the T on the side of said crossbar portion opposite the depending stem portion being functionable as a yoke, said portion of said rectangular shape at each end of the crossbar portion of the T being functionable as an over-shoulder covering, said portion of said rectangular shape on each side of the stem of the T being functionable as a front upper torso covering, and said portion of said rectangular shape below the stem of the T being functionable as a front torso covering, said article having a hollow core member about which said roll of sheet stock is wound and additionally including a roll of flexible belting material removably lodged within said hollow core member.

19. The article of claim 18 wherein said flexible belting material comprises a film of flexible organic plastics material.

20. As a new article of manufacture: disposable apron stock consisting essentially of a roll of flexible sheet material having defined therein, by transverse lines at which said sheet material is readily severable, a plurality of disposable aprons of rectangular shape, each having an interior severance line in the shape of a T openable for a head to pass through, with the crossbar portion of the T below but proximate to and parallel with one of the narrower sides of said rectangular shape, and with the depending stem of the T approximately equally spaced from and parallel to each of the longer sides of said rectangular shape and depending no more than midway the total length of said rectangular shape, the expanse of apron rectangular shape below the stem of the T being characterized as the lower apron portion, said apron sheet material between the crossbar of the T and said one narrow side being functionable as a yoke, said apron sheet material at each end of the crossbar portion of the T being functionable as an over shoulder covering, and said apron sheet material on each side of the stem of the T being functionable as an upper torso covering, said article additionally including a flexible belting roll comprising a belting sheet material having defined therein, by longitudinal lines at which said belting sheet material is readily severable, a plurality of disposable belts, said belting sheet material being accordion folded transversely to said severance lines thereof with the accordion folded severance lines thereof lying in the axial direction in said belting roll.

21. As a new article of manufacture: disposable apron stock consisting essentially of a roll of flexible sheet material having defined therein, by transverse lines at which said sheet material is readily severable, a plurality of disposable aprons of rectangular shape, each having an interior severance line in the shape of a T openable for a head to pass through, with the crossbar portion of the T below but proximate to and parallel with one of the narrower sides of said rectangular shape, and with the depending stem of the T approximately equally spaced from and parallel to each of the longer sides of said rectangular shape and depending no more than midway the total length of said rectangular shape, the expanse of apron rectangular shape below the stem of the T being characterized as the lower apron portion, said apron sheet material between the crossbar of the T and said one narrow side being functionable as a yoke, said apron sheet material at each end of the crossbar portion of the T being functionable as an over shoulder covering, and said apron sheet material on each side of the stem of the T being functionable as an upper torso covering, said article having a hollow core member about which said roll of apron stock is wound and additionally including a roll of flexible belting material removably lodged within said hollow core member.

22. The article of claim 21 wherein said flexible belting material comprises a film of flexible organic plastics material.

23. The method of manufacturing disposable torso-cover sheet stock in the form of a roll of a longitudinal length of flexible sheet material from which discrete individual disposable torso covers are readily severable, with each discrete disposable torso cover consisting of a rectangular shape of said sheet material and having internal lines of severability exclusively within said rectangular shape, each said rectangular shape torso cover consisting solely of a single layer thickness of said sheet material throughout the entire expanse of said torso cover rectangular shape, said method consisting of (i) folding a longitudinal length of said sheet material with the fold edge extending in the direction of the longitudinal length and with the opposing longitudinal side edges of the sheet material in mating face-to-face relationship, (ii) forming lines of severance transversely to and completely through said folded longitudinal length at longitudinally spaced locations to thereby define the limits of length of each said disposable torso cover of rectangular shape in said roll, (iii) forming a straight crossbar severance line in parallel spaced relationship to each said transverse line of severance, said crossbar lines extending from a location approximately midway between the folded longitudinal length over to said fold edge thereof, (iv) forming a straight stem severance line along the fold edge of said sheet material for each said crossbar severance line and in meeting relationship thereto, whereby said crossbar and stem severance lines form an interior severance line of T-shape entirely within each rectangular expanse of a discrete individual disposable torso cover of rectangular shape in said roll, and (v) rolling said folded longitudinal length of said sheet material into a roll of overlapping convolutions from which said discrete disposable torso covers of rectangular shape are readily severable at said transverse lines of severance, there being no portion of a said rectangular shape that requires removal therefrom to form a said torso cover.

* * * * *